US005992403A

United States Patent [19]

Slates

[11] Patent Number: 5,992,403

[45] Date of Patent: Nov. 30, 1999

[54] ARCHERY BOW STABILIZER

[75] Inventor: Scott O. Slates, St. Charles, Mo.

[73] Assignee: Toxonics Manufacturing, Inc., Wentzville, Mo.

[21] Appl. No.: 09/110,999

[22] Filed: Jul. 6, 1998

[51] Int. Cl.[6] ..... F41B 5/20

[52] U.S. Cl. ..... 124/89

[58] Field of Search ..... 124/86, 88, 89

[56] References Cited

U.S. PATENT DOCUMENTS

| | | | |
|---|---|---|---|
| 3,342,172 | 9/1967 | Sanders | 124/89 X |
| 3,502,062 | 3/1970 | Shurts | 124/89 X |
| 4,054,121 | 10/1977 | Hoyt | 124/89 |
| 4,553,522 | 11/1985 | Topping | 124/89 |
| 5,239,977 | 8/1993 | Thomas | 124/89 |
| 5,320,085 | 6/1994 | Hanneman | 124/89 |
| 5,531,211 | 7/1996 | Wilfong | 124/86 |

*Primary Examiner*—John A. Ricci
*Attorney, Agent, or Firm*—Paul M. Denk

[57] ABSTRACT

A stabilizer is provided which is movable in two planes relative to the bow. The stabilizer includes an arm and a stabilizer bar. The arm has a fixed end which is pivotally mounted to the bow so that the stabilizer can be pivoted relative to the bow. The stabilizer bar is received in a free end of the arm and is slidable relative to the arm. Thus, the stabilizer is movable in a generally vertical plane and a generally horizontal plane. Tighteners are provided to secure the stabilizer in a desired angular and horizontal position.

1 Claim, 2 Drawing Sheets

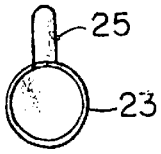
FIG.6
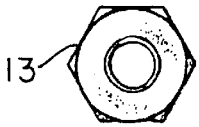
FIG.9
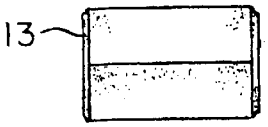
FIG.10
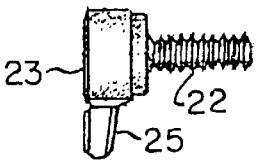
FIG.7
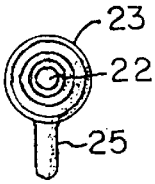
FIG.8
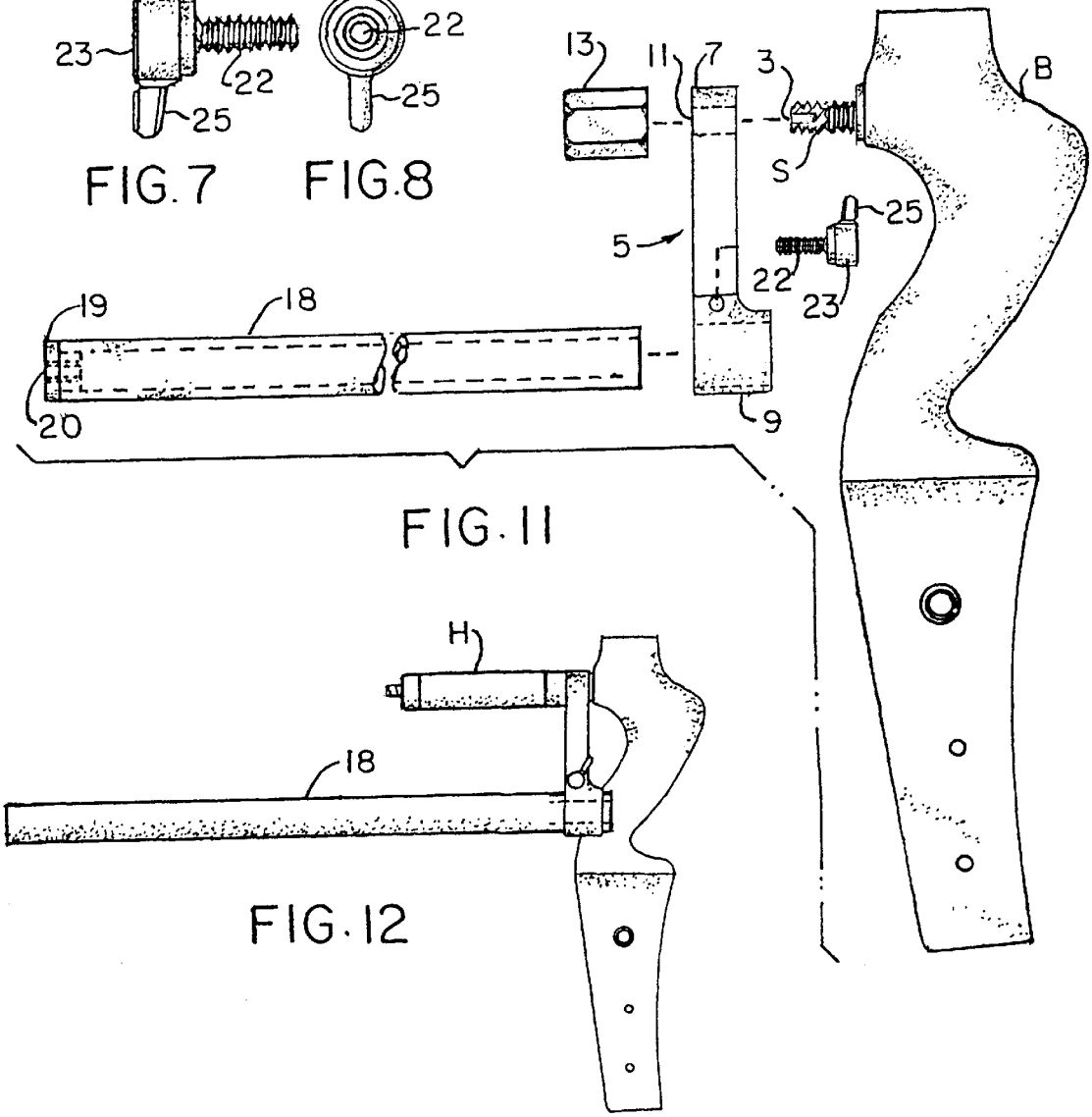
FIG.11
FIG.12

ARCHERY BOW STABILIZER

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention relates to bow stabilizers, and in particular, to a single stabilizer which can be used to offset the weight of several attachments to a bow.

To ensure an accurate shot, an archer's bow must be properly balanced. If the bow is not properly balanced, the arrow shot will not be true. That is, various forces will cause the bow to pull to one side or another, or cause the bow to lift up or pull down. All this, can obviously affect the archer's shot.

Typically, an archer will add or mount various items to the bow. Such items include, for example, bow sights, arrow quivers, and stabilizers. These items are typically mounted on one side of the bow. To counteract the weight of the attachments to the bow, counter-balances are provided on the opposite side of the bow. All the attachments add extra weight to the bow. However, it is generally desired to keep the bow as light as possible.

BRIEF SUMMARY OF THE INVENTION

A primary object of the present invention is to provide a counter-balance/stabilizer combination which can substantially eliminate the need for multiple counter-balances and separate stabilizers for a bow.

Another object is to provide such a counter-balance/stabilizer which is adjustable in at least two planes or has at least two degrees of freedom.

Another object is to provide such a counter-balance/stabilizer which will add only a limited amount of weight to a bow.

These and other objects will become apparent to those skilled in the art upon a review of the following description and accompanying drawings.

Briefly stated, a stabilizer is provided which is pivotally mountable to a bow. The bow includes a mounting bar. The stabilizer includes an arm and a stabilizer bar. The arm has a fixed end which is journaled about the mounting bar and a free end which slidingly receives the stabilizing bar. The stabilizing bar is received in the arm to extend at least slightly forwardly of the bow. A tightener is provided to secure the stabilizing bar at a desired position relative to the arm. The arm free end includes a hole therethrough through which the stabilizer bar extends. A slot which extends from an outer surface of the free end to the free end hole. The slot is sufficiently large to enable the free end to flex at least slightly. The free end tightener includes a threaded bolt which extends at least partially through the arm free end and across the free end slot. Thus, the bolt is tightened, the free end will constrict about the stabilizer bar to secure the stabilizer bar in a desired position. The fixed end of the arm includes a hole extending sized to fit about the bow mounting bar. The mounting bar is at least partially threaded and has a length greater than the length of the arm fixed end hole. A tightener is provided which is threadable about the mounting bar to secure the arm to said bow.

The new stabilizer of the present invention is movable in two planes relative to the bow. Initially, the arm can be pivoted to a desired angular position relative to the bow, and held in that position. Thus, the stabilizer is movable in a generally vertical plane. Secondly, the stabilizer bar may be moved forwardly and backwardly relative to the bow and the stabilizer arm. Thus, the stabilizer is movable in a generally horizontal plane.

BRIEF DESCRIPTION OF THE SEVERAL VIEWS OF THE DRAWINGS

FIGS. 6–8 are front, side, and back elevational views, respectively, of a tightening member used with the mounting arm;

FIGS. 9 and 10 are front and side elevational views of a tightening nut used to tighten the mounting arm to the bow;

FIG. 11 is an exploded side elevational view of the counter-balance/stabilizer mounted to a bow; and FIG. 12 is a side elevational view of the counter-balance/stabilizer and a separate stabilizer mounted to the bow.

Corresponding reference numerals will be used throughout the several figures of the drawings.

DETAILED DESCRIPTION OF THE INVENTION

Figure 1:
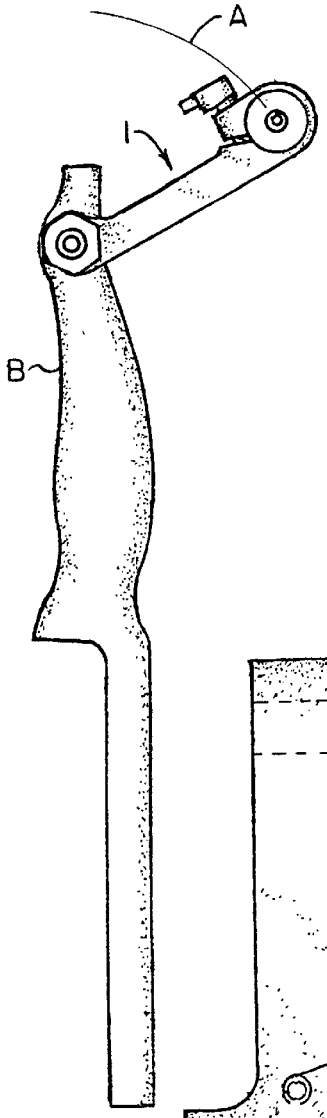
FIG. 1 is front elevational view of the counter-balance/stabilizer of the present system mounted to a bow.
Figure 2:
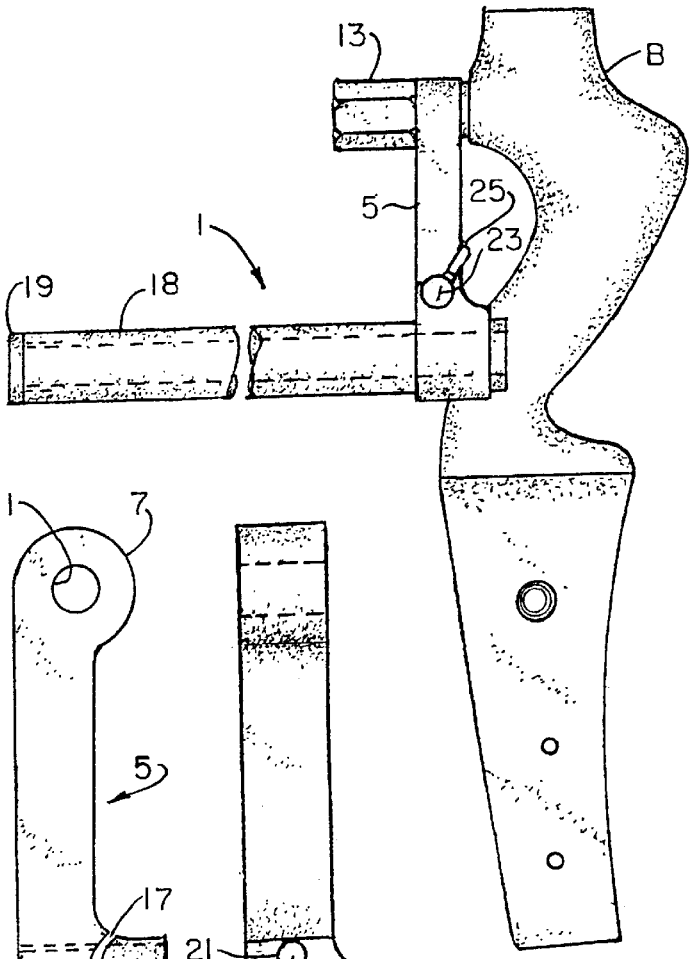
FIG. 2 is a side elevational view of the counter-balance/stabilizer mounted to a bow.
Figure 3:
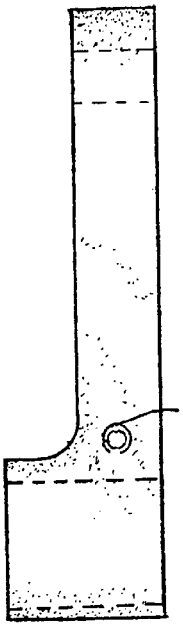
FIGS. 3–5 are side and front elevational views of a mounting arm for the counter-balance/stabilizer.
Figure 4:
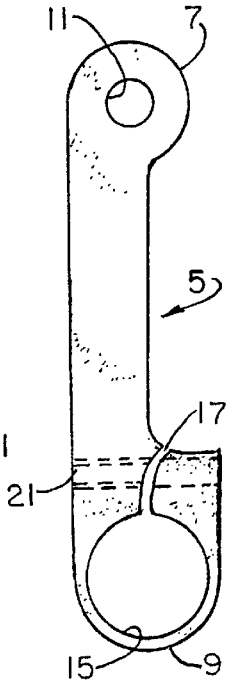
Figure 5:
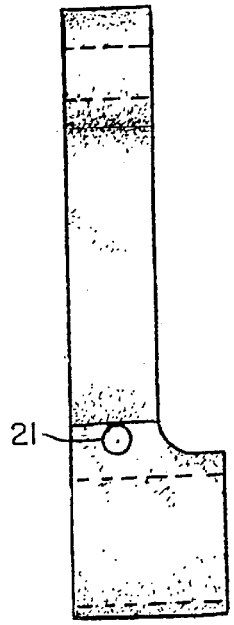

The following detailed description illustrates the invention by way of example and not by way of limitation. This description will clearly enable one skilled in the art to make and use the invention, and describes what I presently believe is the best mode of carrying out the invention.

A bow B includes a mounting screw S extending forwardly from its grip section. A counter-balance/stabilizer 1 of the present invention is mounted to the bow B by means of the screw S, as will be described below. Preferably, the mounting screw S has a counter-bore 3 to allow for a hydraulic stabilizer H (FIG. 12) to be mounted to the bow in addition to the counter-balance/stabilizer 1.

The counter-balance/stabilizer 1 includes a mounting arm 5 having a fixed end 7 and a free end 9. The fixed end 7 is generally circular in shape and has an opening 11 which is sized to be passed over the bow's mounting screw S. The fixed end 7 has a width less than the length of the screw S, such that the screw S will extend beyond the front of the arm when the arm's fixed end placed over the screw. An elongate hex bolt 13 is threaded over the screw S to hold the mounting arm to the bow B, as seen in FIG. 11. When the arm 5 is mounted to the bow B, it can be pivoted about the screw S and held in a desired angular position by the bolt 13.

The free end 9 of the arm 5 is also generally circular in plane and includes a hole 15 extending therethrough. A slot 17 is formed in the free end 9 which passes from the outer surface of the free end to the hole 15. The slot 17 enables the free end 9 to be contracted slightly. The hole 15 is sized to slidingly accept an elongate static stabilizing bar 18. When the stabilizing bar 18 is inserted in the arm 5, it extends perpendicularly to the bow forwardly and/or rearwardly of the bow B. Preferably, the stabilizing bar 18 is hollow. The stabilizing bar 18 may be closed at one end by a cap 19. The cap 19 can be provided with a threaded central opening 20 to accept a hydraulic stabilizer, for example. The arm free end 9 has a bore 21 which is at least partially threaded. The bore 21 extends perpendicularly to the axis of the hole 15 and extends across the slot 17. A bolt 22 is received in the bare 21, and when tightened, constricts the hole 15 about the stabilizing bar 18. The stabilizing bar 18 can be secured in the arm hole 15 at any relative position of the stabilizing bar by tightening of the bolt. Preferably, the bolt 22 is provided with a cap 23 having a lever 25 to make tightening and loosening of the bolt 22 easier.

As can be appreciated, the relative distance that the stabilizing bar 18 extends forwardly and/or rearwardly of the bow can be set at any desired position along the length of the stabilizing bar 18. That is, the stabilizing bar can extend fully forwardly of the bow, fully rearwardly of the bow, or any amount in between. Further, the angular position of the stabilizing bar 18 may be set by positioning the arm 5 at any desired angular position along the arc A (FIG. 1). By changing the angular position of the arm 5, the amount of counter-balance weight (force) applied by the stabilizer bar 18 can be selectively adjusted. Depending on the amount of counter-balance force required, the use of extra counter-balances can be reduced or even eliminated by properly setting the angular position of the arm 5. Further, by selecting the appropriate position of the stabilizer 18 along the arc A, the amount of stabilizing force provided by the stabilizer bar 18 can also be adjusted. The stabilizer bar 18, as noted, is hollow. It can be filled with a fluid tube to convert it to a hydraulic stabilizer. Alternately, a hydraulic stabilizer can be mounted to the end cap 19 of the stabilizer bar 18.

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense. For example, the arm 5 can be made to be extendible to further increase (or decrease) the amount of counter-balance force that can be applied by the counter-balance/stabilizer 1. This example is merely illustrative.

I claim:

1. In combination, an archery bow and a stabilizer, said stabilizer being pivotally mounted to said bow, said bow including a mounting bar extending from said bow, said stabilizer including an arm and a stabilizer bar, said arm having a fixed end which is journaled about said mounting bar and a free end which slidingly receives said stabilizer bar, said stabilizer bar extending at least slightly forwardly of said bow, said stabilizer bar further including a tightener for securing said stabilizing bar at a desired position relative to said arm, said stabilizer arm free end includes a hole therethrough through which said stabilizer bar extends, said free end having a slot which extends from an outer surface of said free end to said free end hole, said slot being sufficiently large to enable said free end to flex at least slightly, said free end tightener including a threaded bolt which extends at least partially through said arm free end and across said free end slot, whereby when said bolt is tightened, said free end will constrict about said stabilizer bar, said fixed end of said arm includes a hole extending therethrough, said fixed end hole being sized to accept said bow mounting bar, said bow mounting bar being at least partially threaded and having a length greater than the length of said arm fixed end hole, and said combination including a tightener which is threadable about said mounting bar to secure said arm to said bow.

* * * * *